US005651735A

United States Patent [19]

Baba

[11] Patent Number: 5,651,735

[45] Date of Patent: Jul. 29, 1997

[54] KENO MACHINE WITH TWO SEPARATE PLAYS

[75] Inventor: Shigeki Baba, Tokyo, Japan

[73] Assignee: Sega Enterprises, Ltd., Japan

[21] Appl. No.: 332,072

[22] Filed: Nov. 1, 1994

[30] Foreign Application Priority Data

Nov. 1, 1993 [JP] Japan ..... 5-273659

[51] Int. Cl.[6] ..... A63F 9/24

[52] U.S. Cl. ..... 463/18

[58] Field of Search ..... 273/138 A, 139, 273/85 CP, 144 R, 269, 272, 294; 463/18

[56] References Cited

U.S. PATENT DOCUMENTS

| | | | |
|---|---|---|---|
| 4,037,845 | 7/1977 | Hooker | 273/138 A |
| 5,129,652 | 7/1992 | Wilkinson | 273/139 |
| 5,224,706 | 7/1993 | Bridgeman et al. | 273/85 CP |
| 5,380,007 | 1/1995 | Travis et al. | 273/144 R X |
| 5,401,024 | 3/1995 | Simunek | 273/138 A |
| 5,431,408 | 7/1995 | Adams | 273/292 X |

*Primary Examiner*—Raleigh W. Chiu
*Assistant Examiner*—Michael O'Neill
*Attorney, Agent, or Firm*—Dickstein Shapiro Morin & Oshinsky

[57] ABSTRACT

The keno playing machine according to the present invention comprises selecting means for selecting a plurality of the keno balls less than a set number out of keno balls displayed on a display screen in accordance with a player's operation, extracting means for extracting at random a required number of the keno balls out of the keno balls displayed on the display screen, first counting means for comparing the extracted keno balls to the selected keno balls to count hit winning balls, additionally extracting means for additionally extracting a required number of the keno balls out of the rest keno balls except said extracted keno balls when a number of the winning balls counted by the first counting means is above a set number, second counting means for comparing the additionally extracted keno balls to the selected keno balls to count a number of hit winning balls, and paying means for paying odds, based on a total of said number of the winning balls counted by the first counting means and said number of the additional winning balls counted by the second counting means, whereby addition of extra games can increase higher hit probabilities without changes to total hit probabilities.

16 Claims, 10 Drawing Sheets

<30 SPOTS> WITHOUT EXTRA BALLS

| SPOT | HIT | PROB. (%) | FREQUENCY |
|---|---|---|---|
| 10 | 5 | 18.338 | 1/5 |
| | 6 | 8.305 | 1/12 |
| | 7 | 2.423 | 1/41 |
| | 8 | 0.43546 | 1/230 |
| | 9 | 0.04344 | 1/2302 |
| | 10 | 0.001824 | 1/54855 |
| TOTAL | | 29.546 | |

FIG.10A

<30 SPOTS> WITHOUT EXTRA BALLS

| SPOT | HIT | PROB. (%) | FREQUENCY |
|---|---|---|---|
| 10 | 5 | 18.338 | 1/5 |
| | 6 | 8.305 | 1/12 |
| | 7 | 0.8091 | 1/124 |
| | 8 | 1.3146 | 1/76 |
| | 9 | 0.6711 | 1/149 |
| | 10 | 0.1084 | 1/923 |
| TOTAL | | 29.546 | |

FIG.10B

<20 SPOTS>

| SPOT | HIT | PROB. (%) | FREQUENCY |
|---|---|---|---|
| 10 | 5 | 5.143 | 1/19 |
| | 6 | 1.148 | 1/87 |
| | 7 | 0.1611 | 1/621 |
| | 8 | 0.0135 | 1/7407 |
| | 9 | 0.0006121 | 1/163372 |
| | 10 | 0.0000112 | 1/8912656 |
| TOTAL | | 6.466 | |

FIG.10C

KENO MACHINE WITH TWO SEPARATE PLAYS

BACKGROUND OF THE INVENTION

The present invention relates to a game playing machine, particularly a keno playing machine which is an electronic game machine for playing keno, and a keno playing method.

The keno playing machine, using which a player plays keno watching the display screen, has conventionally many versions, but their playing methods are substantially as will be described below.

First, a player inserts coins, and then selects and spots (marks) 2 to 10 out of keno balls (balls) numbered 1 to 80 on the display screen.

Then, the player starts the keno. The keno playing machine extracts 20 balls, based on random numbers and spots the extracted ones of the 80 balls on the display screen.

Then the keno playing machine judges how many balls spotted by the player are included in the 20 balls spotted by the keno playing machine, and pays odds corresponding to a number of the included balls.

But such keno is monotonous and in addition has low high-win ratios, which has made the keno unpopular.

SUMMARY OF THE INVENTION

An object of the present invention is to provide a game playing machine and a game playing method having game modes which give an impression of easy wins but give suitable frequencies of high wins which yield profits.

The above-described object is achieved by a game playing machine comprising: selecting means for selecting a plurality of balls out of balls displayed on a display screen in accordance with a player's operation; extracting means for extracting at random a first required number of the balls out of the balls displayed on the display screen; first counting means for comparing the extracted balls to the selected balls to count first hit balls; additionally extracting means for additionally extracting et random a second required number of the balls out of the rest balls except said extracted balls; second comparing means for comparing the additionally extracted balls to the selected balls to count second hit balls; and paying means for paying odds based on a total of the first hit balls and the second hit balls.

In the above-described game playing machine, it is preferable that, when a number of the first hit balls is below a set number, the additional extraction is not performed.

In the above-described game playing machine, it is preferable that, when all the selected balls agree to the extracted balls, the additional extraction is not performed.

In the above-described game playing machine, it is preferable that a number of the selected balls is below a number of the extracted balls.

The above-described object is achieved by a keno playing machine comprising: selecting means for selecting a plurality of the keno balls out of keno balls displayed on a display screen in accordance with a player's operation; extracting means for extracting at random a required number of the keno balls out of the keno balls displayed on the display screen; first counting means for comparing the extracted keno balls to the selected keno balls to count hit winning balls; additionally extracting means for additionally extracting a required number of the keno balls out of the rest keno balls except said extracted keno balls when a number of the winning balls counted by the first counting means is above a set number; second counting means for comparing the additionally extracted keno balls to the selected keno balls to count hit winning balls; and paying means for paying odds, based on a total of said number of the winning balls counted by the first counting means and said number of the additional winning balls counted by the second counting means.

In the above-described keno playing machine, it is preferable that, when all the selected keno balls hit to the extracted keno balls, the additional extraction by the additionally extracting means is not performed.

The above-described object is achieved by a game playing method comprising the steps of: selecting a plurality of balls out of balls displayed on a display screen in accordance with a player's operation; extracting at random a first required number of the balls out of the balls displayed on the display screen; comparing the extracted balls to the selected balls to count first hit balls; additionally extracting at random a second required number of the balls out of the rest balls except said extracted balls; comparing the additionally extracted balls to the selected balls to count second hit balls; and paying odds based on a total of the first hit balls and the second hit balls.

In the above-described game laying method, it is preferable that, when a number of the first hit balls is below a set number, the additional extraction is not performed.

In the above-described game laying method, it is preferable that, when all the selected balls agree to the extracted balls, the additional extraction is not performed.

In the above-described game laying method, it is preferable that a number of the selected balls is below a number of the extracted balls.

The above-described object is achieved by a keno playing method comprising the steps of: selecting a plurality of the keno balls out of keno balls displayed on a display screen in accordance with a player's operation; extracting at random a required number of the keno balls out of the keno balls displayed on the display screen; comparing the extracted keno balls to the selected keno balls to count hit winning balls; additionally extracting a required number of the keno balls out of the rest keno balls except said extracted keno balls when a number of the winning balls is above a set number; comparing the additionally extracted keno balls to the selected keno balls to count hit winning balls; and paying odds, based on a total of said number of the winning balls and said number of the additional winning balls.

In the above-described keno playing machine, it is preferable that, when all the selected keno balls hit to the extracted keno balls, the additional extraction is not performed.

The keno playing machine according to the present invention comprises: selecting means for selecting a plurality of the keno balls less than a set number out of keno balls displayed on a display screen in accordance with a player's operation; extracting means for extracting at random a required number of the keno balls out of the keno balls displayed on the display screen; first counting means for comparing the extracted keno balls to the selected keno balls to count hit winning balls; additionally extracting means for additionally extracting a required number of the keno balls out of the rest keno balls except said extracted keno balls when a number of the winning balls counted by the first counting means is above a set number; second counting means for comparing the additionally extracted keno balls to the selected keno balls to count hit winning balls; and paying means for paying odds, based on a total of said number of the winning balls counted by the first counting means and said number of the additional winning balls counted by the second counting means, whereby addition of extra games can increase higher hit probabilities without changes to total hit probabilities.

BRIEF DESCRIPTION OF THE DRAWINGS

FIGS. 10A to 10C are views of hit probabilities and frequencies, FIG. 10A being an explanatory view of those of the case of the present invention without extra balls, FIG. 10B being an explanatory view of those of the case of the present invention with extra balls, and FIG. 10C being an explanatory view of those of the conventional game.

DETAILED DESCRIPTION OF THE INVENTION

The keno playing machine according to one embodiment of the present invention will be explained with reference to the drawings.

Figure 1:
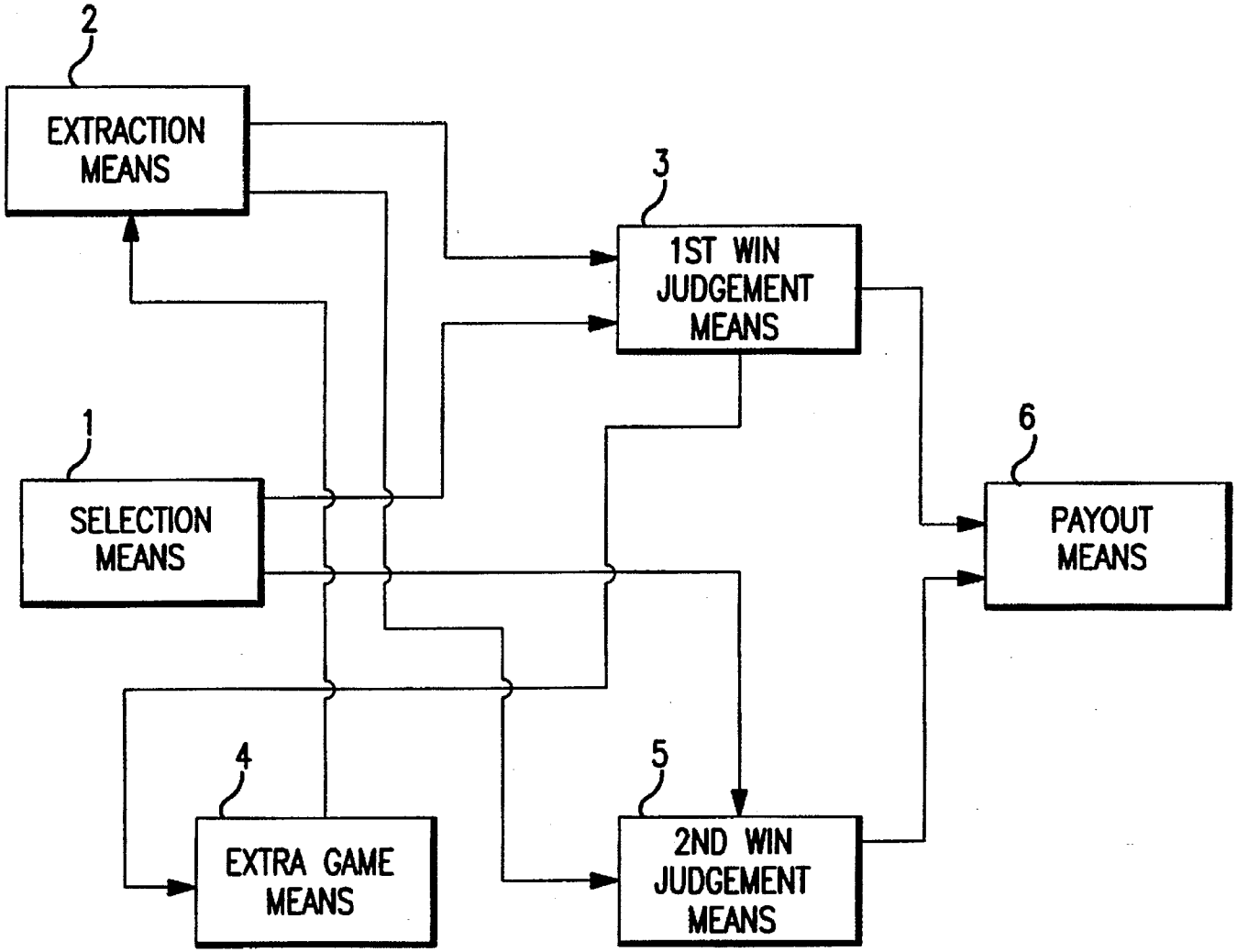
FIG. 1 is a block diagram showing the function of the keno playing machine according to one embodiment of the present invention.

FIG. 1 shows the function of the keno playing machine according to one embodiment of the present invention.

In accordance with a player's selecting operation, selecting means 1 selects a required number of the keno balls which are displayed in a set number on a display screen (not shown), and extracting means 2 extracts at random the required number of the keno balls on the display screen.

Following the extraction by the extracting means 2, first win judging means 3 compares the extracted keno balls by the extracting means 2 to the selected keno balls by the selecting means to judge a first win.

After the first win is judged, extra game means 4, the first winning keno balls corresponding to the first win are worth an extra game, and when they are worth an extra game, the extracting means 2 additionally extracts at random a required number of the rest keno balls except the extracted keno balls.

Following the extraction by the extracting means 2, second win judging means 5 compares the additional keno balls to the extracted keno balls to judge a second win.

Paying means 6 adding a number of the second winning balls won by the second win to a number of the first winning balls won by the first win, and paying odds corresponding to a total winning ball number.

Figure 2:
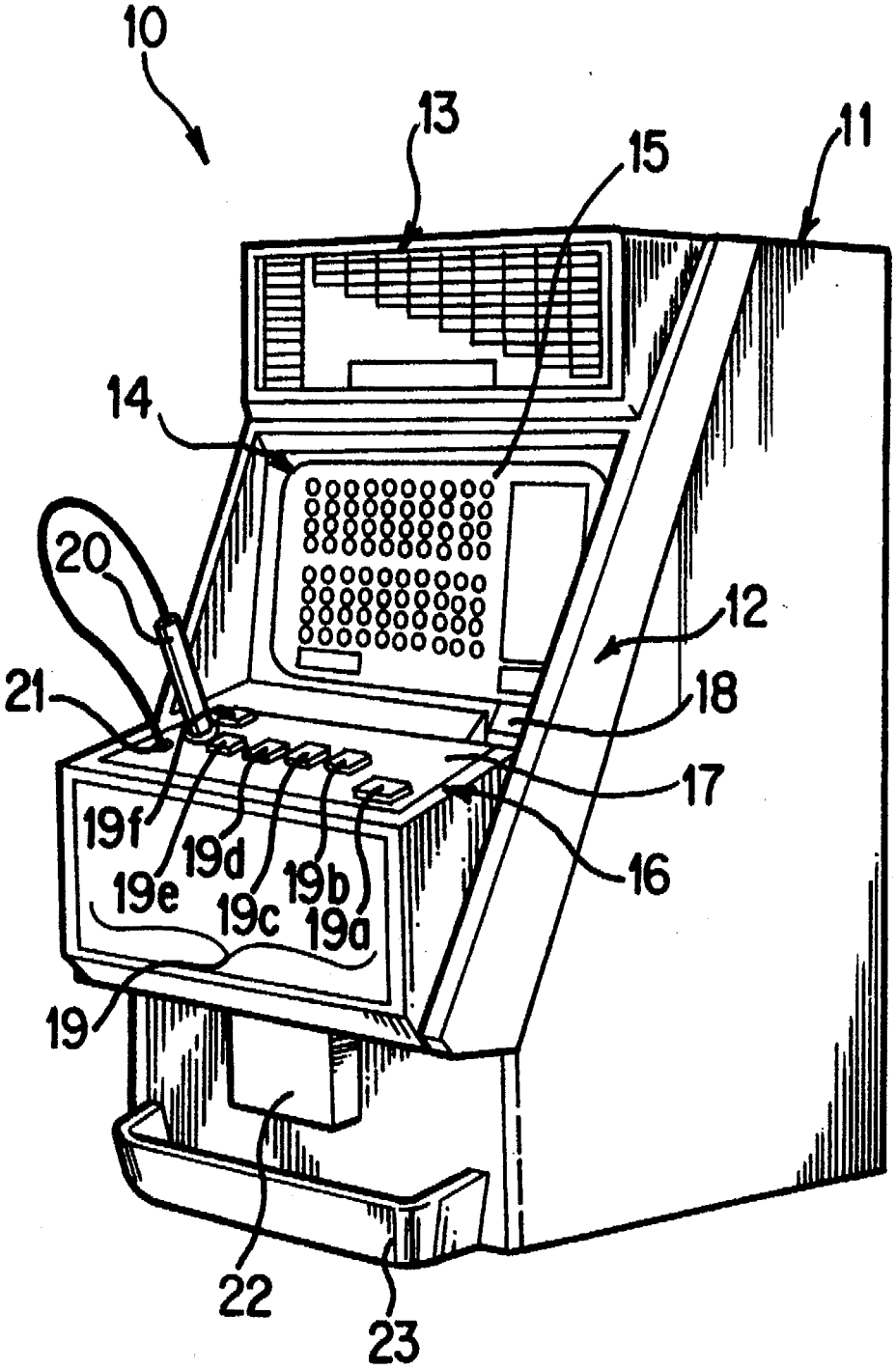
FIG. 2 is an explanatory view of the appearance of the keno playing machine of FIG. 1.

FIG. 2 shows the appearance of the keno playing machine 10.

The keno playing machine 10 has a front door 12 mounted on the front of the machine body by means of hinges (not shown) capably of being opened and closed. The front door 12 is opened to inspect the interior of the machine body 11 or supply ticket sheets, etc.

On upper part of the front door 12 there is provided a display panel 13 on which odds corresponding to hit numbers are displayed, end a display window 14 is formed below the display panel 13. A display screen 15 of a CRT 28 can be observed through the display window 14.

On substantially all the display screen 15 except a right part, 80 individually distinguishable keno balls (balls) numbered 1 to 80, which are used in the keno, are displayed up and down in two 40-ball groups. On the right part, numbers of hit ones of the spots, numbers of won coins (odds) to be paid, etc. are displayed as the game proceeds. On a lower part of the display screen 15, a number of inserted wager, a number of a credit, instructions necessary to advance a game, etc. are displayed.

Below the display window 14 a console 16 is formed projected a little beyond the front door 12.

A control panel 17 is provided on the top surface of the console 16. A coin slot 18 is formed in the inner right part of the top surface of the console 16. On the top surface of the control panel 17 there are provided various operational buttons 19 for advancing a game, i.e., a start/repeat button 19*a*, a one-bet button 19*b*, a MAX bet button 19*c*, an erase button 19*d* and a print ticket button 19*e* arranged from the right in one horizontal row, and a service button 19*f*, etc. provided on an inner left part thereof. On the outer left part of the control panel 17 a light pen 20 for selecting balls is removably placed in an accommodation portion 21.

A coin ticket outlet 23 is projected below the console 16. A coin ticket pan 23 is provided below the coin ticket outlet 22.

The game machine body 11 incorporates a CPU, a ROM, a CRT controller, an input board, an output board, etc. as control means for controlling proceeding of a game.

Figure 3:
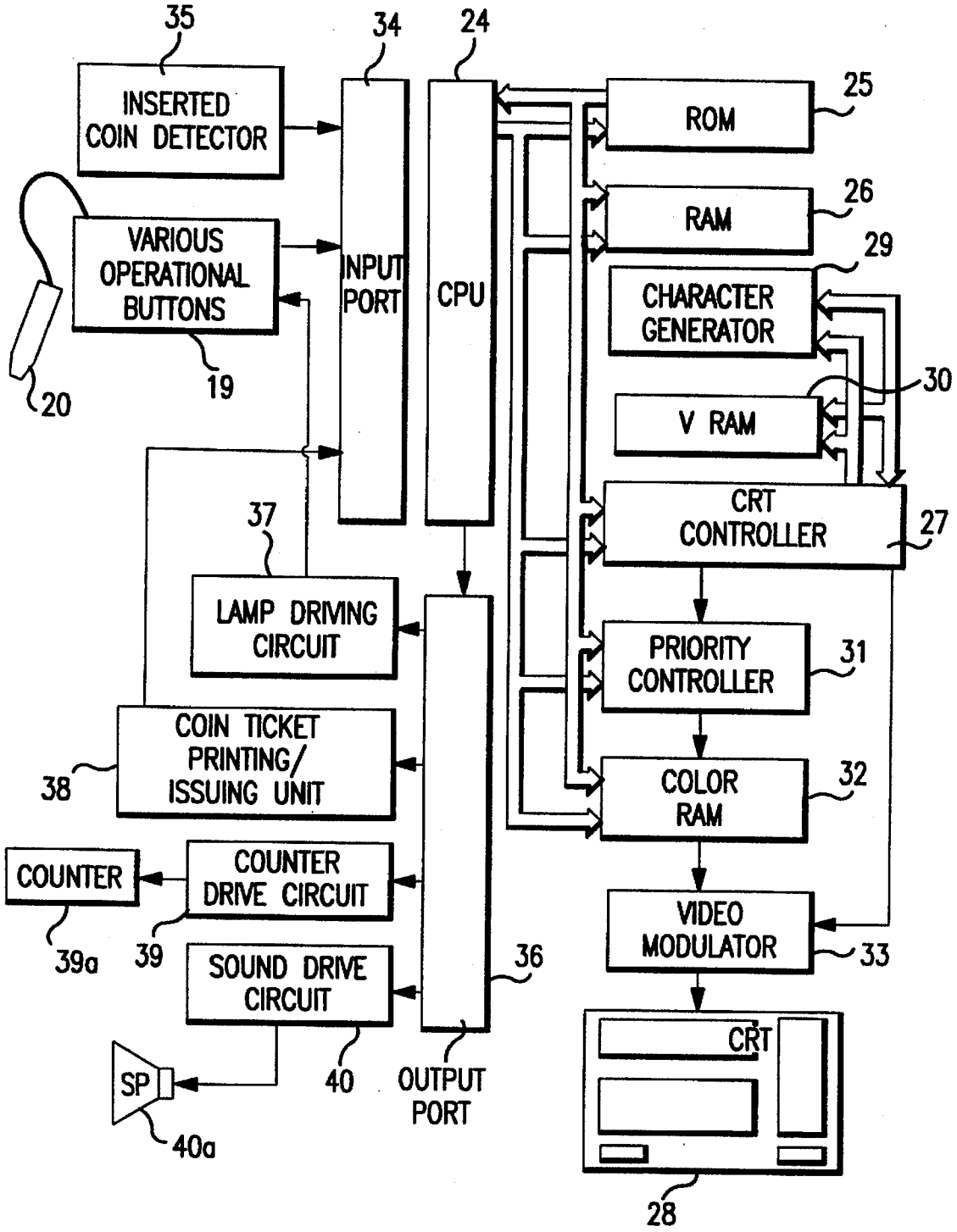
FIG. 3 is a block diagram of the control system of the keno playing machine of FIG. 1.

FIG. 3 shows the block diagram of the unit of these control members.

The CPU 24 writes and reads data in and from the RAM 26 as required, in accordance with programs stored in the ROM 25 to conduct various processings, and controls input of operational signals from the various operational buttons 19 through an input port 34 which will be described later, and output of instruction signals to various apparatuses through an output port 36 are controlled by the CPU 24.

The various processings of the CPU 24 include: an extraction processing for extracting at random a required number of balls out of a set number of keno balls 16 after a player has selected a plurality of balls which are less than a set number; a first win judgement processing for comparing the extracted balls with the selected balls to judge a first win; an extra game processing for judging whether the first win balls for the first win is worth an extra game, and when they are worth an extra game, further extracting at random a required number of additional balls out of the rest kino balls except the extracted balls; a second win judgement processing for comparing the additional extracted balls with the selected balls to judge a second win; and a payment processing for combining a number of second win balls of the second win with a number of the first win balls of the first win, and paying odds corresponding to a number of a total win ball.

The ROM 25 has, in addition to an exclusive area for storing a program for controlling an entire game, respective exclusive areas for a random number generating program, various data of letters, ball patterns, etc., and a program for image processing, etc.

The RAM 26 has areas for storing a number of inserted coins before start of a game, a memory area for storing data of spotted balls and hit balls, data of a number of coins to be paid, a number of a credit, a number of actually paid coins, etc., and an area for storing some variables.

The CRT controller 27 stores in a character generator 29, in accordance with a control operation of the CPU 24, image patterns of patterns required for display on the display screen of the CRT 28 out of the image data of letters and ball patterns stored in the ROM 25. The CRT controller 28 also stores in the video RAM (VRAM) 30 object codes of the patterns indicative of where the patterns to be displayed on the screen.

The CRT controller 27 supplies to a priority controller 31, in accordance with a control operation of the CPU 24, image pattern data corresponding to position data in the RAM 30 from the image pattern date stored in the character generator 29.

The priority controller 31 determines priority for superposed images, etc. and supplies color position data to a color RAM 32. The color RAM 32 supplies color data for each bit of the image to a video modulator 33. The video modulator 33 converts parallel digital color data from the color RAM 32 into serial data and analog signals and supplies the same to CRT 28 in synchronization with video signals to display the required images on the display screen 15.

Signals are supplied to the input port 34 from an inserted coin detector 35, the various operational buttons 19 on the control panel 17, the light pen 20, a coin ticket printing/issuing unit 38, etc..

The output port 36 outputs respective instruction signals to a lamp drive circuit 37 for lighting lamps (not shown) incorporated in the operational buttons 19, the coin ticket printing/issuing unit 38 for printing a number of credit coins on a ticket and issuing the ticket when a game is over, a counter drive circuit 39 for driving a counter **3*a*, a sound drive circuit 40 for driving a speaker (SP) 40*a* to let out different melodies in accordance with wins a player makes in a game. The counter 39*a*** stores a number of inserted coins, times of playing a game, a total credit paid on coin tickets, etc.

Then, the operation and the contents of the keno playing machine having the above-described structure will be explained with reference to FIGS. 4 to 9.

Figure 4:
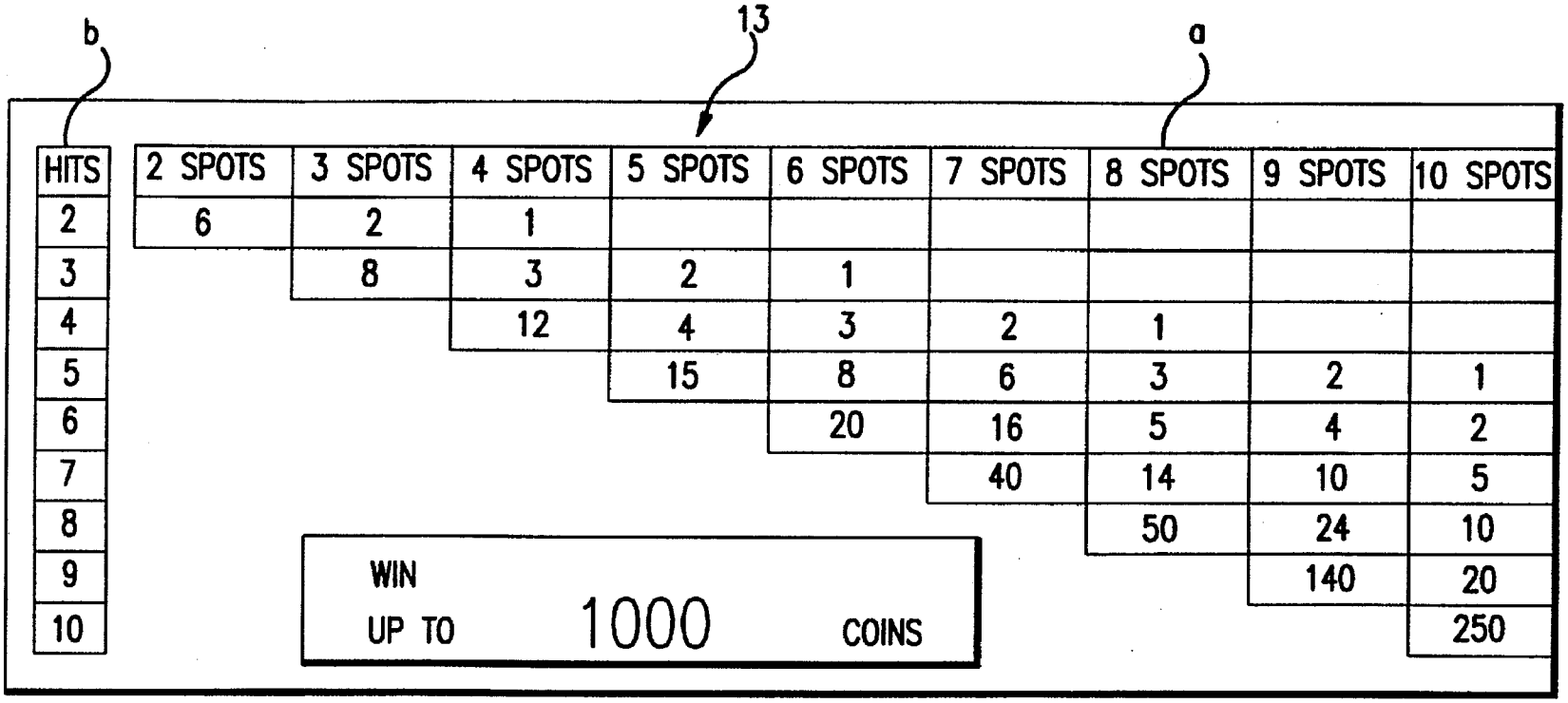
FIG. 4 is a view explaining an Odd table of spots vs. hits displayed in the display panel.

FIG. 4 is a table of odds corresponding to hit spot numbers displayed on a display panel 13 disposed on an upper part of the front door 12. Spot numbers "2 to 10" are displayed in one horizontal row at an upper part of a frame (a), and odds are displayed vertically in a column below each of the spot numbers. In a frame (b) on the right side end hit numbers "2 to 10" are displayed vertically in one column.

Thus, it is seen in this odds table that in a case, for example, that a player spotted "7" balls and proceeded to a game, and got "5" hits, the number "6" in the column of the spot "7" on the level of the hit number "5" in the frame (b), is odds to be paid to the player.

In this embodiment a game follows The following play rule.

1. A player can select 2 to 10 balls. The keno playing machine extracts 30 out of 80 balls and pays odds for a number of hit ones of the extracted 30 balls.

2. When the player has a winning hit more than "5-4" (4 hits for 5 spotted balls), "6-5", "7-6", "8-6", "9-7" and "10-7", the machine extracts 15 balls of the remaining 30 balls and pays odds for a total number of hit balls.

Figure 5:
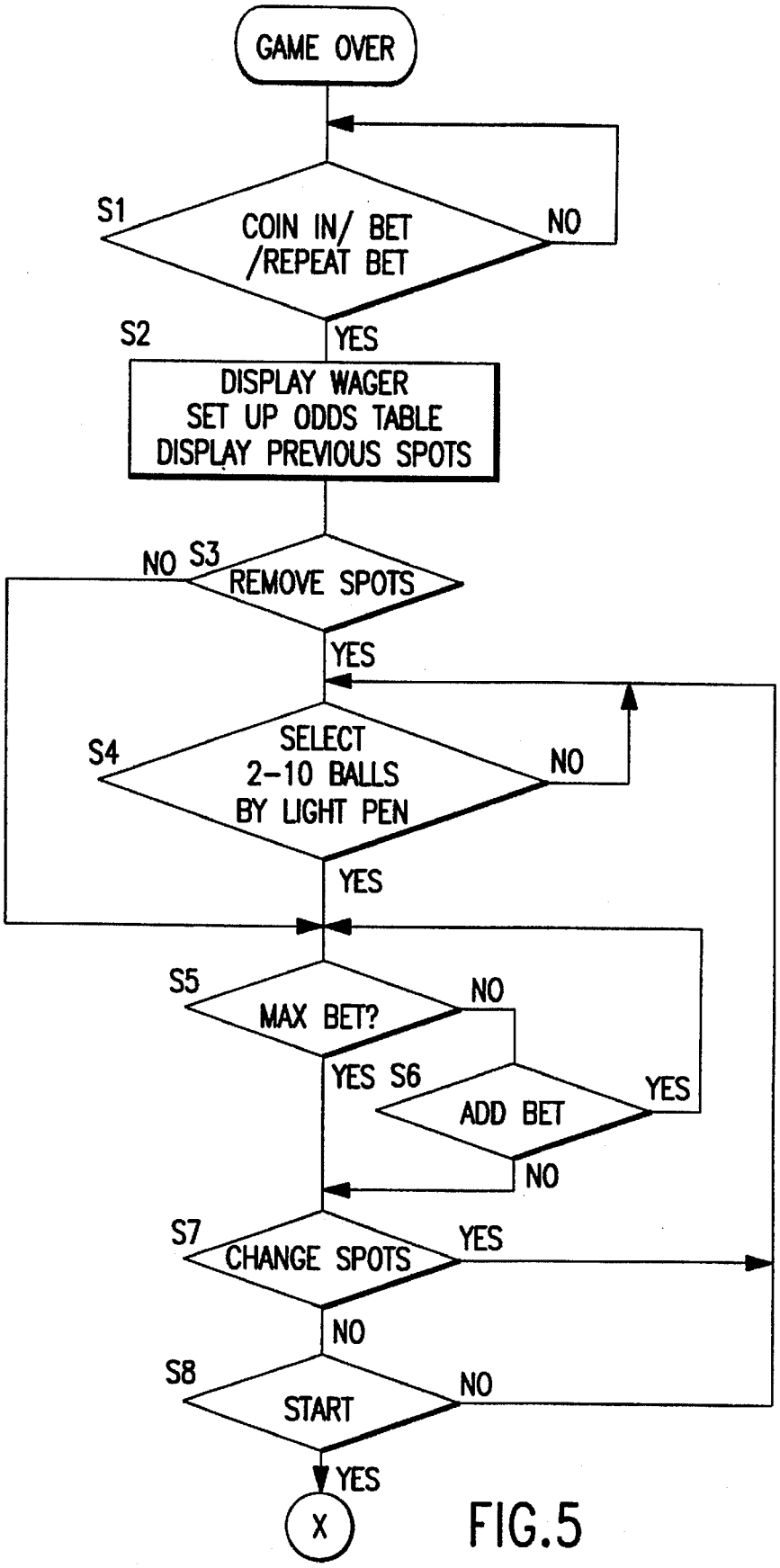
FIG. 5 is a flow chart (part 1) of the operation of the keno playing machine of FIG. 1.
Figure 6:
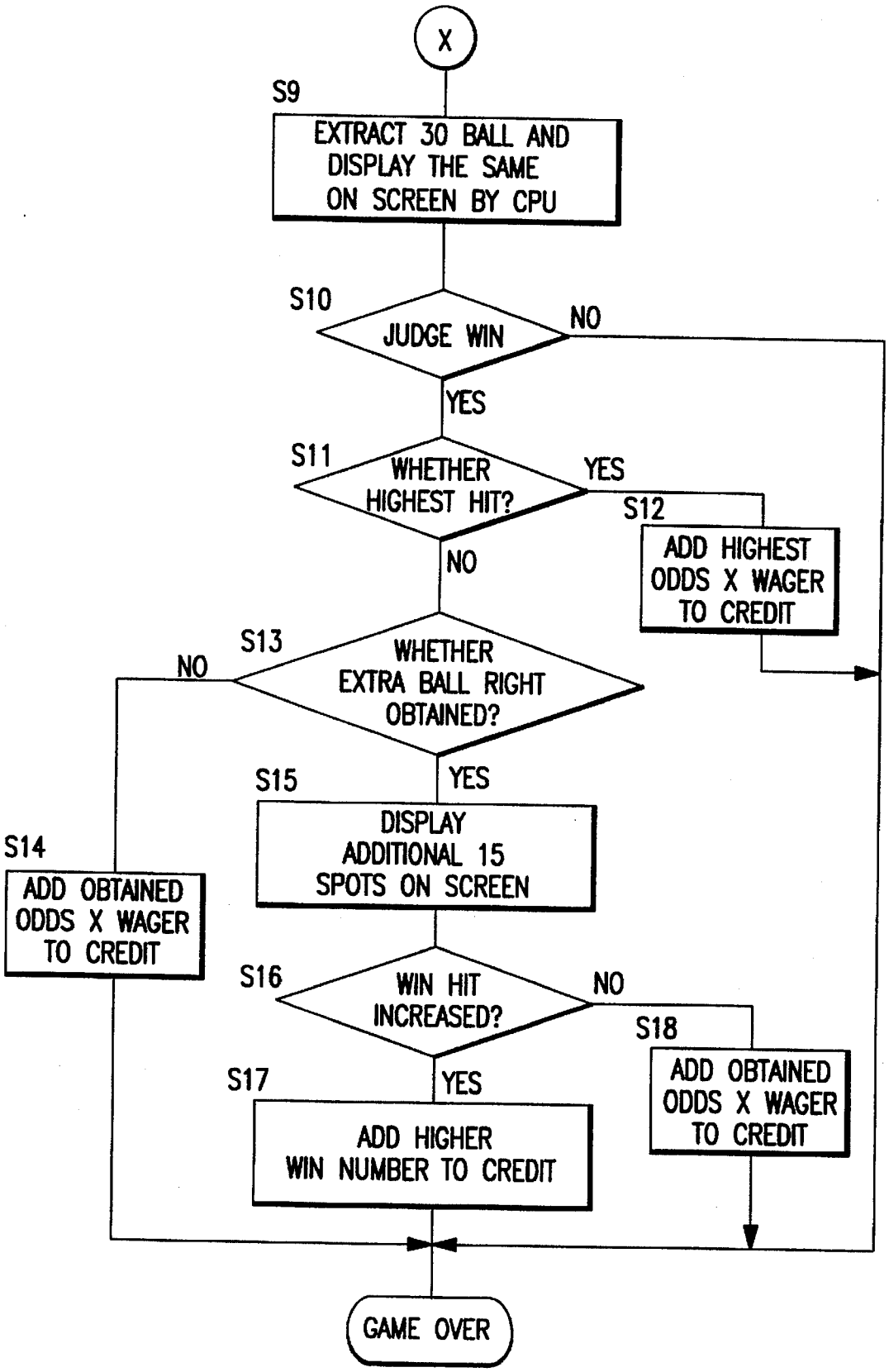
FIG. 6 is a flow chart (part 2) of the operation of the keno playing machine of FIG. 1.

The proceeding of the game will be explained with reference to the flow charts of FIGS. 5 and 6.

The keno playing machine 10 standing by for the start of a game displays on and off the letters "INSERT COINS" (not shown) on an instruction display section of the display screen 15. The display screen 15 is sectioned, in addition to the instruction display section (c), in a wager display section (d) on a lower left end, a credit display section (e) on a lower right end, ball display sections (f), (g) up and down on a most left half side, a spot number display section (h) on an upper right side, a hit spot number display section (i) below the spot number display section (h), an odds display section (j) on the right side of the spot and the hit number display sections, and a hit number display section (k) between the ball display sections (f), (g) (see FIG. 7).

First, to determine a bet, coins are inserted into the slot 18 (COIN IN), or when there is a credit, the one-bet button **19*b* or the MAX bet button 19*c* is operated (BET), or when the stand-by with a bet for a previous game is acceptable, a no-change operation (REPEAT BET) is made (Step S1**).

Then, the bet is thus determined, and a number of the bet is displayed in the wager display section (d) (WAGER DISPLAY), odds corresponding to the wager being displayed in the odds display section (j) (ODDS TABLE SET UP). In the spot number display section (h) a number of spotted balls the player spotted in the previous game remain displayed (PREVIOUS SPOT DISPLAY) (Step S2).

Subsequently when a change is made to a number of the spotted ball displayed in the spot display section (h), if additional 10 balls, for example, are spotted, the erase button **19*d* is pressed to erase the spot number (Step S3), and 2 to 20 (a plural number smaller than a set number) out of 80 balls of two 40-ball groups in the ball display sections (f), (g) are suitably selected and spotted (Step S4**).

Figure 7:
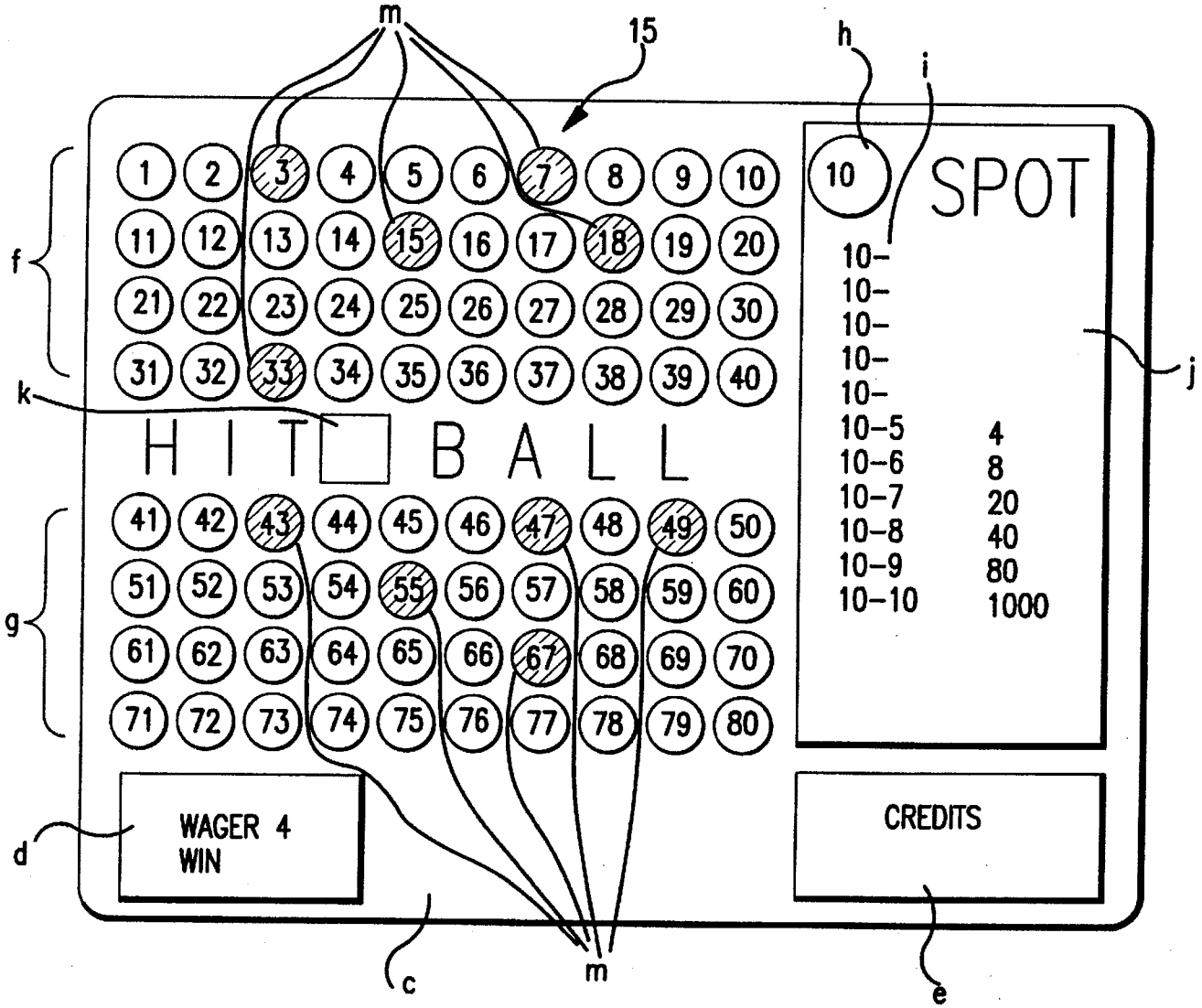
FIG. 7 is a view explaining one example of spotted keno balls by a player.

This state is shown in FIG. 7. On the display screen 15, the maximum spotted 10 balls (m) (selected keno balls) are displayed discriminated from the rest balls in the ball display sections (f), (g), and the FIG. 10 indicating that 10 balls have been spotted is displayed in the spot number display section (h). In the hit number display section (i), a hit number per the spot number is displayed, and in the odds display section (j) odds for the respective hits are displayed. In this embodiment, a displayed bet in the wager display section (d) is 4, which is the maximum in this embodiment, and the odds of a value four times the value in the odds table (see FIG. 4) is displayed.

Then, after balls are spotted, or when a spotted ball number is not changed in Step S3, selection of conditions whether or not a bet number is made maximum (MAX BET?) follows. When a bet has not been inserted up to the maximum number 4, it is decided whether or not an additional bet is inserted (Step S6). To insert the additional bet, Step S6 is returned to Step S5.

As the maximum wager is 4 in this embodiment, Step S5 is followed by a next step.

Subsequently when no additional bet is inserted, or when the bet is judged the maximum bet number in Step S5, it is decided whether or not spots are changed (SPOT CHANGE) (Step S7). According to a rule of this game, spots may be changed any time before the game is started. When a spot change is required, the step is returned to Step S4 to make the change by the light pen 20.

Then, when no spot change is required, the start/repeat button **20*a* is pressed to start the game (START). When the game is not started, the step is returned to Step S4 (Step S8**).

Subsequently in response to the start of the game, the CPU 24 computes to extract at random 30 (required number) out of the 80 balls (extraction processing), and sequentially spots the extracted balls on the display screen 15 at a suitable timing (Step S9).

Figure 8:
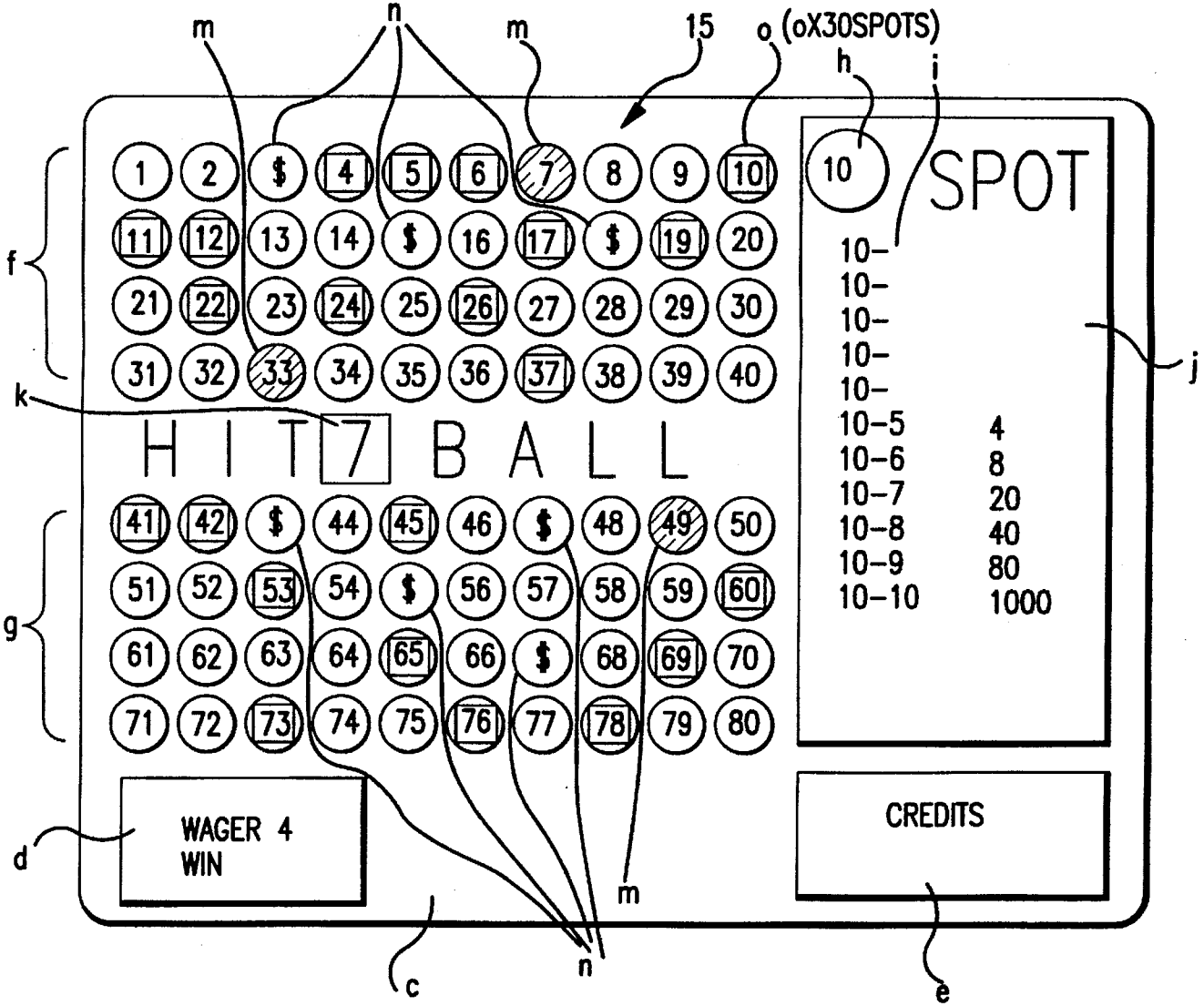
FIG. 8 is a view explaining one example of displays on the display screen in a first game.

FIG. 8 shows one example of displays of 30 spotted extracted balls (extracted keno balls).

In the game hits are made by agreement of those of the spotted balls (m) by a player with those of the extracted balls by the CPU 24 (a first win judgement), and a number of hits is displayed in a figure in the hit number display section (k), while the numbers of the hit balls are changed to a symbol (letter S, see FIG. 8) to indicate the hit balls (n).

Then, based on a decided hit number, the CPU 24 computes to judge a win (WIN JUDGEMENT, a first win judgement processing) (Step S10).

As seen in the odds table, a win is decided when a number of hits is, per a number of spots, more than a specific number. In this embodiment, since a spot number is 10, a hit number of 5 or more is judged a win.

Accordingly when a hit number is less than 5, a judgement is NO, and the game is over (GAME OVER), and the letters "GAME OVER" are displayed in the instruction display section (c). When a hit number is 5 or more, a judgement is YES, and a next step follows.

In this embodiment, since hit balls (n) are 7, the judgement is YES, and a next step follows.

Subsequently it is judged whether or not the hit is highest (Step S11).

When the hit is highest, odds given by multiplying highest odds by a bet number is added to a credit (Step S12), and a number of the credit is displayed in the credit display section (e). And the game is over. In this embodiment a hit number 7 is not the highest hit.

Then, when the hit is not highest, the judgement whether or not a right to an extra ball game (additional game) has been obtained (additional game judgement) is made (Step S13).

An extra game is made in accordance with a game rule "when a winning hit of '10-7 (7 hit balls per 10 spotted balls') or more is obtained, the game machine extracts 15 balls out of the rest 50 balls".

For example, when a hit ball number is 5 or 6, a right to an extra ball game is not obtained. Accordingly odds 1 or 2 in the odds table is multiplied by a bet number of 4, and 4 or 8 is added to a credit (Step 1). A number of the credit number is displayed in the credit display section (e), and the game is over.

Subsequently a number 7 of hits yields an extra ball game right, and the extra ball game is automatically conducted (additional game processing). The CPU 24 computes to extract at random 15 additional balls out of the rest balls (extraction processing), and additionally spots sequentially at a suitable timing the extracted balls on the display screen 15 (Step S15).

Figure 9:
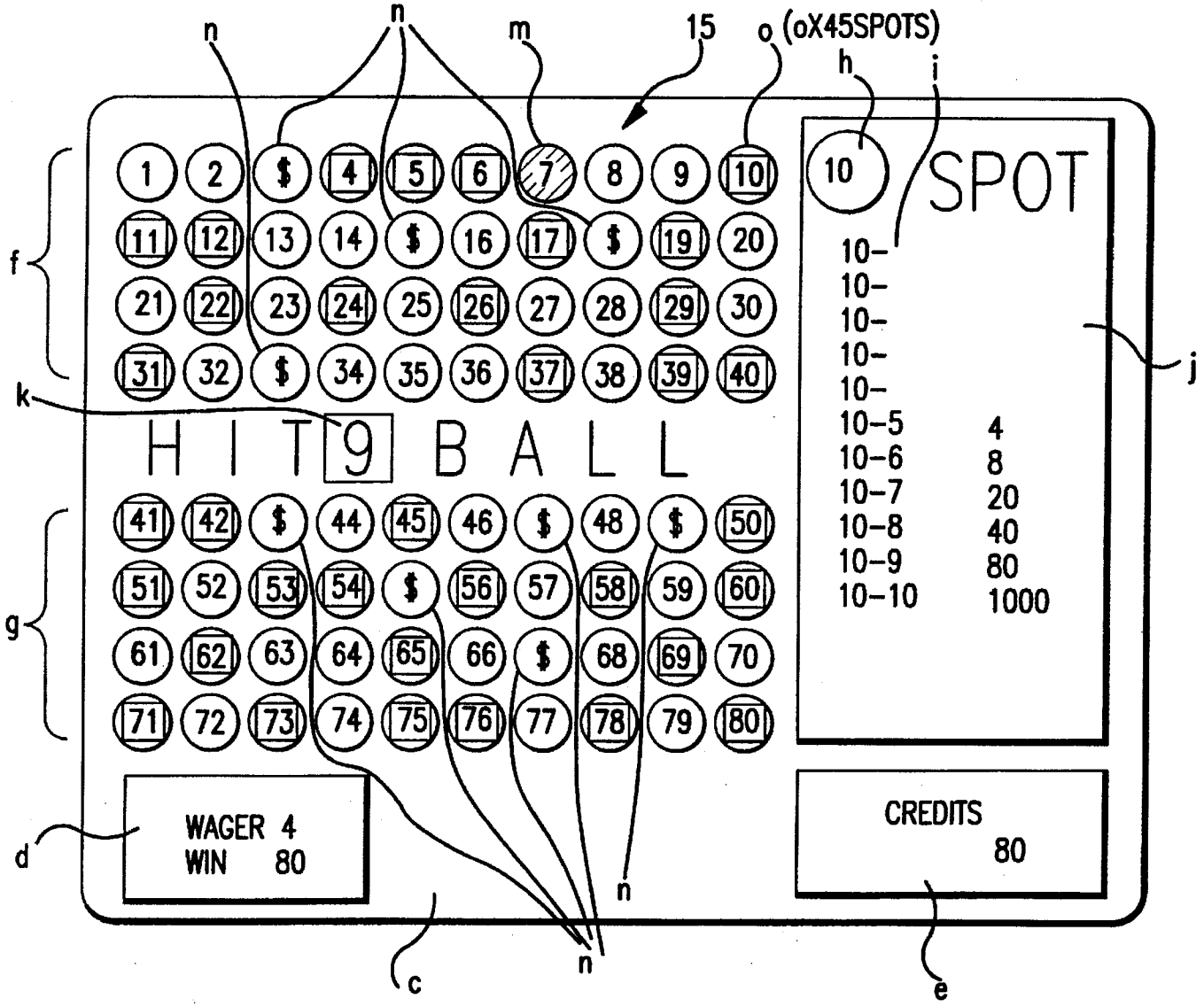
FIG. 9 is a view explaining one example of displays on the display screen in a second game.

FIG. 9 shows one example of displays of total 45 spotted balls (o) of 30 spotted balls and 15 additionally extracted spotted balls (additional keno balls).

Then, a judgement whether or not a number of hits yielding a win has been increased (a second win judgement) is made (Step S16).

As shown in FIG. 9, in this game, a hit number is displayed in FIG. 9 in the hit number display section (k), end the numbers of the hit balls (n) are changed to a symbol (letter S), and the hit number is increased by 2.

Then, the odds for a hit number 9 which has been increased by 2 and corresponds to a higher win number is added to the credit (a second win judgement processing) (Step S17). In the odds table, the odds corresponding to a hit number 9 is 20 and odds 80 given by multiplying the odds 20 by a bet number of 4 is added to the credit (payment processing), and the credit figure is displayed in the credit display section (e). And the game is over.

On the other hand, when no additional hits are obtained, and the hit number is not increased, odds 20 given by multiplying the odds 5 corresponding to the obtained hit number 7 by a bet number of 4 is added to the credit (Step S18), and the credit figure is displayed in the credit display section (e). And the game is over.

When a credit is available, if the previous game is repeated, the start/repeat button 19*a* is pressed, and the game can be set ready to start with all set as in the previous game (with a bet number and a spotted ball number of the previous game left). When spots are changed, the change can be made by the light pen 20 (Step S4). After the change, the start/repeat button 19*a* is pressed, whereby the CPU 24 computes to extract the balls (Step S9). The following step processings are automatically conducted.

When a credit is available, and the game is not played any more, the print ticket button 19*e* is pressed, and a coin ticket with a credit number printed thereon by the coin ticket printing/issuing unit 38 is discharged onto the coin ticket pan 23.

After a set period of time from the end of the game, the display in the instruction display section (c) is changed to "INSERT COIN", and the keno playing machine 10 stands by.

The effects of the embodiment of the present invention will be explained based on probability and frequency of hits, etc.

FIG. 10A shows the probabilities (PROBABILITY) and frequencies of hits (HIT) for the case that a player selects 10 spots in a game based on the game rule that 30 spots are extracted out of 80 spots. FIG. 10B shows the probabilities and frequencies of hits for the case that 30 balls are extracted out of 80 balls (a first game), and subsequently an extra game is made (a second game).

FIG. 10C shows, as a control, the probabilities (PROBABILITY) and frequencies of hits (HIT) for the case that a player selects 10 spots in a game based on the game rule that 20 spots are extracted out of 80 spots.

The probabilities of the hits in FIG. 10A, and those in FIG. 10C are naturally indicative of the difference between the game rule that 30 spots are extracted by the computer and the game rule that 20 spots are extracted by the computer. It is seen that the probabilities in all the hits in FIG. 10A are higher.

The probabilities in FIG. 10B were given by the following computation.

It is seen that the probability of the case that in the rule that the CPU 24 computes to extract 30 spots, the probability of 10 spots, for example, being spotted, 7 spots being hit is $$ {}_{30}C_7 \times {}_{50}C_3 \div {}_{80}C_{10} = 2.423\% \quad (1) $$

The probability of the case that a hit number is increased by a following extra ball game resultantly up to a higher win is:

for 1 hit up to 8 hits $$ {}_{15}C_1 \times {}_{35}C_2 \div {}_{50}C_3 = 45.53\% \quad (2) $$

for 2 hits up to 9 hits $$_{15}C_2 \times {}_{35}C_1 \div {}_{50}C_3 = 18.75\% \quad (3)$$

for 3 hits up to 10 hits $$_{15}C_3 \div {}_{50}C_3 = 2.3214\% \quad (4)$$

The total of the probabilities (2), (3), (4), 66.6% is a probability of shifting to higher wins. As a result, the probability of 7 hits is $$(1)-(1)\times((2)+(3)+(4))=0.8091\% \quad (5)$$

In other words, this is a probability for a case that a hit number remains 7 spots.

FIG. 10B shows the respective computed probabilities of 8 hits, 9 hits and 10 hits.

The comparison between FIGS. 10A and 10B shows that there is no difference between the two in the total hit probability, but the extra ball game much raises probabilities for higher wins.

In comparison with the frequency of the highest win yielding 10 hits when 10 balls are spotted in the conventional 20 spot game, it is seen that the frequency is once 8,900,000 times. Certainly the odds is high, but the frequency is hard to imagine.

In contrast to this, the 30-spot+extra ball game according to the present invention produces the highest hit once 923 times.

Such addition of an extra game (the second game) to the 30-spot game (the first game) produces higher hit probabilities as a whole and higher win probabilities. The highest hit can occur about once about 1000 times. A keno game which can produce higher wins at a suitable frequency and is interesting without boring.

Probabilities of higher-win hits can be raised or lowered by suitably increasing and decreasing the number (15) of the extra balls. Accordingly setting for amusability can be changed by changing high-win adds with the relationship of a probability×odds=an expectation satisfied.

The present invention is not limited to the above-described embodiment and cover various modifications. For example, numbers of 80 keno balls are not necessarily 1 to 80 but may be 11 to 90. Instead of numbers, letters, patterns or others which can discriminate individual keno balls may be used.

What is claimed is:

1. A keno playing machine comprising:

a monitor for displaying a set number of keno balls;

selecting means for selecting a plurality of keno balls from the keno balls displayed on said monitor in accordance with a player's operation to start a keno game;

first extracting means for extracting at random a first required number of the keno balls displayed on the monitor;

first win judging means for comparing the extracted keno balls to the selected keno balls and identifying first winning balls therefrom to judge a first win;

second extracting means for causing an extra game to be conducted in response to the first win, wherein said second extracting means extracts at random a second set number of keno balls out of the rest of said displayed keno balls except for said extracted keno balls;

second win judging means for comparing the extracted additional keno balls to said selected keno balls and identifying second winning balls therefrom to judge a second win; and payout means for adding a number of second winning balls corresponding to the second win to a number of the first winning balls to pay odds based on a total of the first and the second winning ball numbers.

2. The game playing machine of claim 1, wherein the first win judging means disables the second extracting means when the number of extracted keno balls that correspond to the selected keno balls does not exceed a first threshold number.

3. The game playing machine of claim 1, wherein the first win judging means disables the second extracting means when each of the selected keno balls corresponds to one of the first extracted keno balls.

4. A keno playing machine comprising:

a monitor for displaying a set number of keno balls which are distinguishable from each other;

selecting means for selecting a plurality of the keno balls out of keno balls on the monitor by an operation of a player to start a keno game;

extracting means for extracting at random a first required number of the keno balls;

first win judging means for comparing the extracted keno balls by the extracting means to the selected keno balls selected by the selecting means and identifying first winning balls therefrom to judge a first win;

extra game means for causing an extra game to be played based on the first winning keno balls wherein the extra game means additionally extracts at random a second required number of the keno balls on the monitor except for the extracted keno balls;

second win judging means for comparing the additionally extracted keno balls to the selected keno balls and identifying second winning balls therefrom to judge a second win; and paying means for adding a number of the second winning balls to a number of the first winning balls to pay odds corresponding to a total of the first and the second winning ball numbers.

5. The keno playing method of claim 4, wherein the step of causing an extra game to be conducted is not performed when the number of extracted keno balls that correspond to the selected keno balls does not exceed a first threshold number.

6. The game playing machine of claim 4, wherein the step of causing an extra game to be conducted is not performed when each of the selected keno balls corresponds to one of the first extracted keno balls.

7. A keno playing method comprising the steps of:

displaying keno balls on a monitor;

selecting a plurality of the keno balls out of the displayed keno balls in accordance with a player's operation to start a keno game;

extracting at random a first required number of the displayed keno balls;

comparing the extracted keno balls to the selected keno balls to identify first winning balls therefrom to judge a first win;

causing an extra game to be conducted, based on a number of first winning balls corresponding to the first win, thereby extracting at random a second set number of keno balls out of the rest of the keno balls except said extracted keno balls;

comparing the extracted additional keno balls to said selected keno balls to identify second winning balls therefrom to judge a second win; and adding a number of second winning balls corresponding to the second win to a number of the first winning balls to pay odds based on a total of the first and second winning ball numbers.

8. The keno playing method of claim 7, wherein the step of causing an extra game to be conducted is not performed when the number of first winning balls does not exceed a first threshold number.

9. The game playing machine of claim 7, wherein the step of causing an extra game to be conducted is not performed when each of the selected keno balls corresponds to one of the first extracted keno balls.

10. A keno playing machine, comprising:

a display screen configured to display a set of balls;

a control panel that accepts input from a player to conduct a keno game; and a controller, wherein the controller selects, in accordance with a player's operation, a plurality of keno balls from the set of keno balls displayed on the display screen;

the controller extracts at random a first number of keno balls from the set of keno balls displayed on the display screen;

the controller compares the extracted keno balls to the plurality of selected keno balls to judge a first win;

the controller causes an extra game to be conducted in response to the first win, wherein the controller extracts at random a second number of keno balls from the remaining, unextracted keno balls displayed on the display screen;

the controller compares the second number of extracted keno balls to the plurality of selected keno balls to judge a second win; and the controller pays odds based on a combined total number of first winning balls and second winning balls.

11. The game playing machine of claim 10, wherein the controller prevents the extra game from being played when the number of first winning balls does not exceed a threshold number.

12. The game playing machine of claim 10, wherein the controller prevents the extra game from being played when each of the selected keno balls corresponds to one of the first extracted keno balls.

13. A keno playing machine, comprising:

a display screen configured to display a set of balls;

a control panel that accepts input from a player; and a controller, wherein the controller selects a plurality of the keno balls out of keno balls on the display screen by an operation of a player;

the controller extracts at random a first number of keno balls from the set of keno balls displayed on the display screen;

the controller judges a first win by comparing the extracted keno balls to the plurality of selected keno balls;

in the event of a first win, the controller extracts at random a second number of keno balls from the remaining, unselected keno balls displayed on the display screen;

the controller judges a second win by comparing the second set of extracted keno balls to the plurality of selected keno balls; and the controller pays odds based on a total number of first winning balls and second winning balls.

14. The game playing machine of claim 13, wherein the controller prevents the extra game from being played when the number of first winning balls does not exceed a threshold number.

15. The game playing machine of claim 13, wherein the controller prevents the extra game from being played when each of the selected keno balls corresponds to one of the first extracted keno balls.

16. The machine of claim 13, wherein the displayed keno balls are each identified by a unique number.

* * * * *